US006321622B1

(12) United States Patent
Tsuge et al.

(10) Patent No.: US 6,321,622 B1
(45) Date of Patent: Nov. 27, 2001

(54) STRUCTURE FOR ATTACHING A SUSPENDING DEVICE TO AN ELECTRIC POWER TOOL

(75) Inventors: Kazunori Tsuge, Okazaki; Yukihiko Yamada, Nagoya; Tomohiro Ukai, Chiryu, all of (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/406,872

(22) Filed: Sep. 28, 1999

(30) Foreign Application Priority Data

Sep. 29, 1998 (JP) ..... 10-275705
Mar. 9, 1999 (JP) ..... 11-062241

(51) Int. Cl.[7] ..... B25B 29/00
(52) U.S. Cl. ..... 81/57.4; 81/185.2
(58) Field of Search ..... 81/52, 54, 185.2, 81/57.4; 408/241 R

(56) References Cited

FOREIGN PATENT DOCUMENTS 4233239 4/1993 (DE) .
51-87791 7/1976 (JP) .
61-1602 1/1986 (JP) .
06285774 10/1994 (JP) .

*Primary Examiner*—D. S. Meislin
(74) *Attorney, Agent, or Firm*—Foley, Hoag & Eliot LLP

(57) ABSTRACT

A screwdriver 1 includes a hook 7 which is configured to fit in an accommodating recess 20 grooved in a motor housing 4 and a handle cover 5. The hook 7 includes an extending portion 8 for being accommodated in a first groove 21 and a base block 9 for being accommodated in a second groove 22. The base block 9 is provided with a pair of slide plates 10 which in turn includes retainer flanges 11 at its free ends. To draw out the hook 7, it is manually pulled up at the top end of the extending portion 8 and slid rearward so that the retainer flanges 11 of the slide plates 10 enter support slots 27 provided at the rear of the second groove 22. Simultaneously, a support plate 12 of the base block 9 abut the top wall 5*a* of the handle cover 5. In this drawn-out position, as the retainer flanges 11 interfere with the edges of the support slots 27, the hook 7 is prevented from slipping out the screwdriver 1 and secured on the handle cover 5 outside the accommodating recess 20.

31 Claims, 12 Drawing Sheets

STRUCTURE FOR ATTACHING A SUSPENDING DEVICE TO AN ELECTRIC POWER TOOL

This application claims priority on Japanese Patent Application No. 10-275705 filed on Sep. 29, 1998 and Japanese Patent Application No. 11-62241 filed on Mar. 9, 1999, the contents of which are incorporated herein by reference.

BACKGROUND OF THE INVENTION

The present invention relates to electric power tools. More particularly. the present invention relates to a structure for attaching a suspending device, such a hook, to an electric power tool.

Electric power tools are often provided with a suspending hook or similar device so as to allow operators to hang the tools up on walls when they are not used. If such hooks cannot be retracted into the bodies of the tools, the hooks tend to get in the way of operators as they protrude from the tools, whereas the hooks may be lost or misplaced if they are removably provided in the tools. For this reason, a suspending hook can be preferably stored within the housing of an electric power tool when it is not used and also be pulled out for use. Japan Published Unexamined Patent Application No. 51-87791 discloses one such retractable suspending hook for use in an electric power tool in which a slit for accommodating the suspending device (hook) is formed in the housing of the tool. The hook is rotatably supported by a pin in the slit. Japan Published Examined Patent Application No. 61-1602 discloses a flush light which includes a retractable suspending device (metal plate) slidably accommodated in a recess formed in the housing and a fixing element (screw) for securing the suspending device at two predetermined positions, one for hooking the light for example, on a wall, and the other for retracting the metal plate flush with the housing. As each of the suspending devices includes a pin or a screw as well as the device itself, this configuration contributes to an overall increase in cost of the tool and time for assembly. In the arrangement disclosed in the former application, due to the manner in which the hook is connected to the tool with a pin, the tool tends to be unstably and unsteadily suspended on the hook. In the arrangement disclosed in the latter application, although the tool can be stably suspended, the fixing element must be operated every time the suspending device is retracted or drawn out, thus reducing the operability of the tool.

SUMMARY OF THE INVENTION

In view of the above-identified problems an important object of the present invention is to provide a structure for attaching, a suspending device to an electric power tool without requiring a separate component.

Another object of the present invention is to provide a structure for attaching a suspending device to an electric power tool that realizes stable suspension of the tool. Still another object of the present invention is to provide a structure for attaching a suspending device to an electric power tool that allows the suspending device to be easy accommodated in and drawn out of the tool.

The above objects and other related objects arc realized by the invention, which provides a structure for attaching a suspending device to a housing of an electric power tool, with the suspending device including a base portion and an extending portion connected to the base portion. The structure includes: an accommodating portion provided in the housing for accommodating the suspending device; retaining, means provided for the base portion, the retaining means being movable within the accommodating portion and preventing the base portion from slipping out of the accommodating portion, wherein the base portion is connected to the accommodating portion so as to permit the base portion to project out of, and retract into, the accommodating portion, support means provided adjacent the accommodating portion for supporting the retaining means when the base portion is projected out of the accommodating portion, wherein the suspending device is accommodated in the accommodating portion when the base portion is retracted into the accommodating portion and the suspending device is drawn out of accommodating portion when the base portion projects out of the accommodating portion.

According to another aspect of the present invention, the structure further includes guide means provided on the accommodating portion for guiding the base portion to the support means.

According to still another aspect of the present invention, the accommodating portion is a recess which is provided in the housing and includes a first groove for accommodating the extending portion and a second groove for accommodating the base portion.

According to yet another aspect of the present invention the suspending device has a generally L-shaped cross section taken along an longitudinal axis thereof, with the vertical stroke of the L corresponds to the extending portion and the horizontal stroke of the L corresponds to the base portion. Furthermore, the suspending device is accommodated in the electric power tool flush with the housing when the base portion is in the accommodating portion.

In accordance with another aspect of the present invention, the electric power tool further includes a tool bit attached to a front end thereof the tool bit having an axis parallel to the longitudinal axis of the suspending device. In addition, the support means is located on a rear end of the electric power tool such that the tool bit, the extending portion, the base portion, and the support means are disposed in that order along the longitudinal axis when the suspending device is accommodated in the accommodating portion, and the base portion travels over the support means when the suspending device is drawn out of the accommodating portion.

In one aspect, the guide means provided on the accommodating portion includes at least one rear inclined surface provided on a wall of the second groove adjacent the support means, the at least one rear inclined surface connecting the second groove and the support means such that the base portion abuts and slides on the at least one rear inclined surface when moved to the support means.

In another aspect, the guide means further includes at least one front inclined surface provided on a wall of the second groove adjacent the first groove for facilitating the movement of the base portion to the support means.

In still another aspect, the base portion has at least one first vertical plate member each having a free end to which the retaining means is attached within the housing and at least one vertical second plate member. Moreover, the support means is provided with an outer surface area of the housing; at least one slot provided in the housing for receiving the at least one first plate member when the base portion is projected out of the accommodating portion; and an undersurface of the second plate member which abuts the outer surface area of the housing when the base portion is projected out of the accommodating portion. Additionally, the first plate member, the second plate member, and the slot are oriented parallel to the longitudinal axis such that the first plate member enters the slot when the base portion is moved to the support means.

To carry out the invention in one preferred mode, the retaining means includes a flange extending from the free end of the at least one first plate member, the flange having a width greater than that of the slot, such that the retaining member, attached to the at least one first plate member inside the housing, prevents the base portion from slipping out of the housing.

In one embodiment, the structure further includes engaging means provided between the suspending device and the accommodating portion for securing the suspending device to the accommodating portion when the suspending device is in the accommodating portion.

In another embodiment, the engaging means includes at least one recess provided in the accommodating portion and further includes at least one protrusion provided on the suspending device for engaging the recess when the suspending device is in the accommodating portion.

In one practice, the engaging, means includes at least one groove provided in the accommodating portion and further includes at least one ridge provided on the suspending device, the at least one ridge engaging the at least one groove when the suspending device is in the accommodating portion.

In another practice, the suspending structure further include second engaging means which includes a second groove provided in the support means and a second ridge provided on the suspending device for engaging the second groove when the suspending device is drawn out of the accommodating portion.

In still another practice, the first groove is configured such that the first groove provides a sufficient gap between a top end thereof and a top end of the extending portion for insertion of a human finger tip into the gap when the suspending device is in the accommodating portion so as to allow the suspending device to be drawn out of the accommodating portion manually.

In yet another practice, the electric tool further includes a handle attached to the housing, and further wherein the suspending device and the accommodating portion are located in the portion of the housing, opposite to where the handle is attached to the housing.

Another aspect of the invention provides an electric power tool that includes a housing and a hook member attached to the housing. The hook member is movable relative to the housing between a retracted position and a deployed position. The housing includes a recess that is adapted for seatingly accommodating the hook member when the hook member is in the retracted position. The recess includes a first track member, and the hook includes a second track member that slidably engages the first track member to slidably move the hook member along a first path relative to the housing, into and alternatively out of the retracted position. In one preferred embodiment, the power tool has a longitudinal axis and the first path has at least a portion extending substantially perpendicular to the longitudinal axis.

According to another aspect, the hook member includes a generally tongue-shaped extending portion and a base portion. The recess includes a first cavity for seatingly accommodating the extending portion, and a second cavity for seatingly accommodating the base portion when the hook member is in the retracted position. In one preferred embodiment, the extending portion includes tapered edges and the second cavity includes receiving tapered edges. A portion of the tapered edges of the extending portion abut the receiving tapered edges of the second cavity when the hook member is in the retracted position. Further, the extending portion of the hook member can include a pair of cut-outs disposed in corners of an end thereof opposite the base portion, and the first cavity can include a pair of retainer lugs for engaging the pair of cut-outs. This engagement retains the hook member stably in the recess when the hook member is in the retracted position.

In another aspect, the electric power tool further includes a third track member on the housing transverse to the first track member, and the hook member includes a fourth track member. The fourth track member is adapted to slidably engage the third track member to slidably move the hook member along a second path transverse to the first path such that the hook member moves successively along the first path and the second path in transition from the retracted position to the deployed position. Further, the first cavity can include tapered edges along a portion thereof for engaging a portion of the tapered edges of the extending portion.

According to another aspect, the base portion forms a substantially normal angle with the extending portion. The base portion can include a pair of slide plates extending from the extending portion parallel to each other and separated from each other by a distance approximately equal to a width of the extending portion. The base portion can further include a pair of retaining flanges, where each flange extends outwardly from one of the slide plates.

In another aspect of the electric power tool of the invention, a support plate is disposed between the pair of the slide plates and parallel therewith. In one embodiment, a transversal plate extends between the slide plates and connects the slide plates together to the support plate. The support plate can include a protrusion on a lower surface thereof, and further the surface of the housing that separates the two portions of the third track member can include a recess for engaging this protrusion, to lock the hook member in the deployed position.

According to another aspect, two surfaces of the slide plates form the second track member and a vertical wall of the second cavity of the recess forms the first track member.

In another aspect of the invention, the third track member is raised relative to the recess, and has two portions separated by a surface of the housing. Further, two horizontal surfaces of the retaining flanges form the third track member. The third track member slidably engages the fourth track member for slidable movement of the hook member along the second path. In one preferred embodiment, the second path is along the longitudinal axis of the power tool.

According to another aspect of the invention, the third track member has a length that is substantially equal to a length of the slide plates.

Other general and more specific objects of the invention will in part be obvious and will in part be evident from the drawings and descriptions which follow.

BRIEF DESCRIPTION OF THE DRAWINGS

For a fuller understanding of the nature and objects of the present invention, reference should be made to the following detailed description and the accompanying drawings, in which.

DESCRIPTION OF ILLUSTRATED EMBODIMENTS

Preferred embodiments according to the present invention will be described hereinafter with reference to the attached drawings.

Embodiment 1

Figure 1:
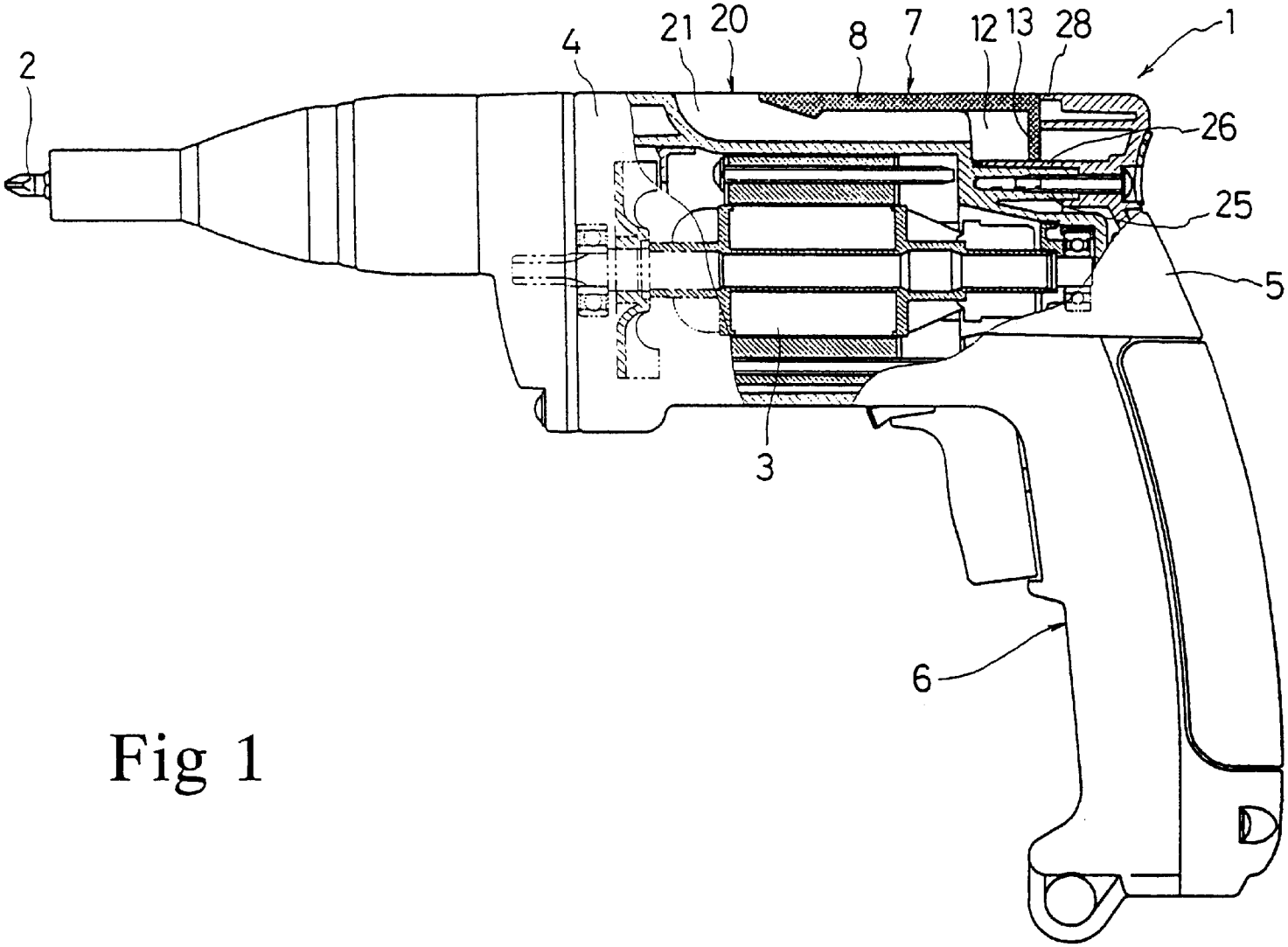
FIG. 1 is a partially cross-sectional side view of an electric power screwdriver of a first embodiment in accordance with the present invention.

FIG. 1 is a partial cross-sectional side view of an electric power screwdriver 1 to which a suspending device according to the present invention is incorporated. The screwdriver 1 includes a motor 3 encased in a motor housing 4 and oriented parallel to a spindle (not shown) and a tool bit 2 interlocked on one end with the spindle and attached on the other end to the top of the screwdriver. The motor 3 rotates the spindle and thus the tool bit 2 when it is driven. A front half of a pistol grip handle 6 is located at the rear of the motor housing 4, to which a handle cover 5, including the rear half of the grip handle 6, is screwed so as to form the grip handle 6. The motor housing 4 and the handle cover 5 together can form a housing for the screwdriver 1.

Figure 2:
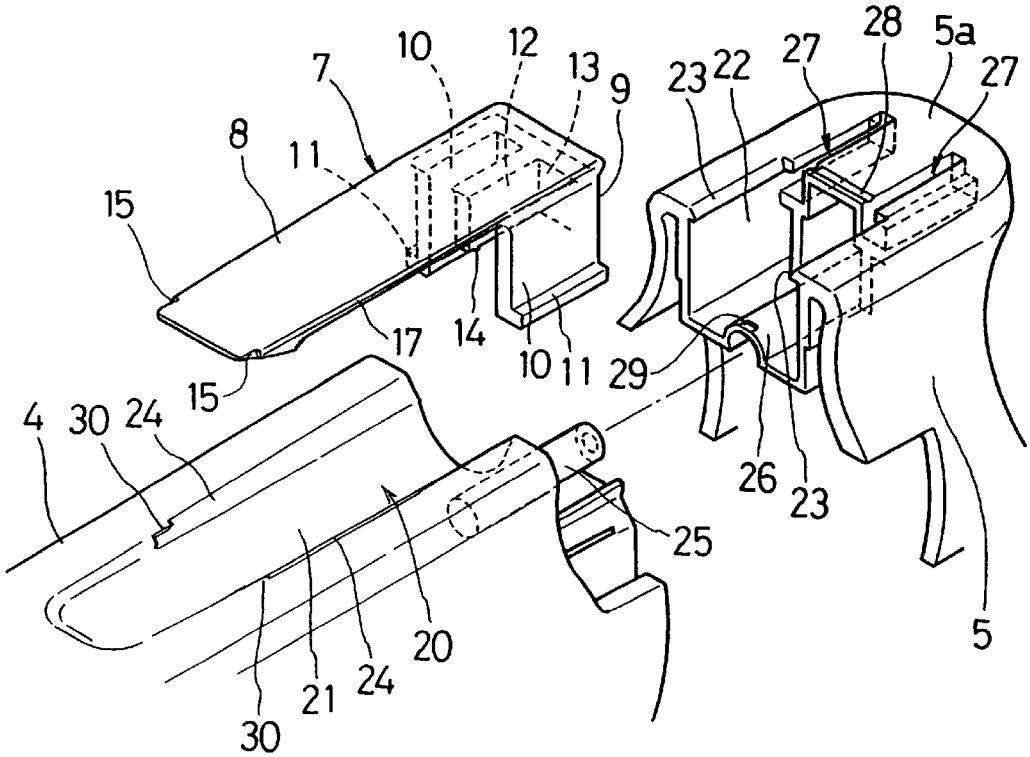
FIG. 2 is an exploded view of a hook and an accommodating recess of the electric power screwdriver shown in FIG. 1.
Figure 4:
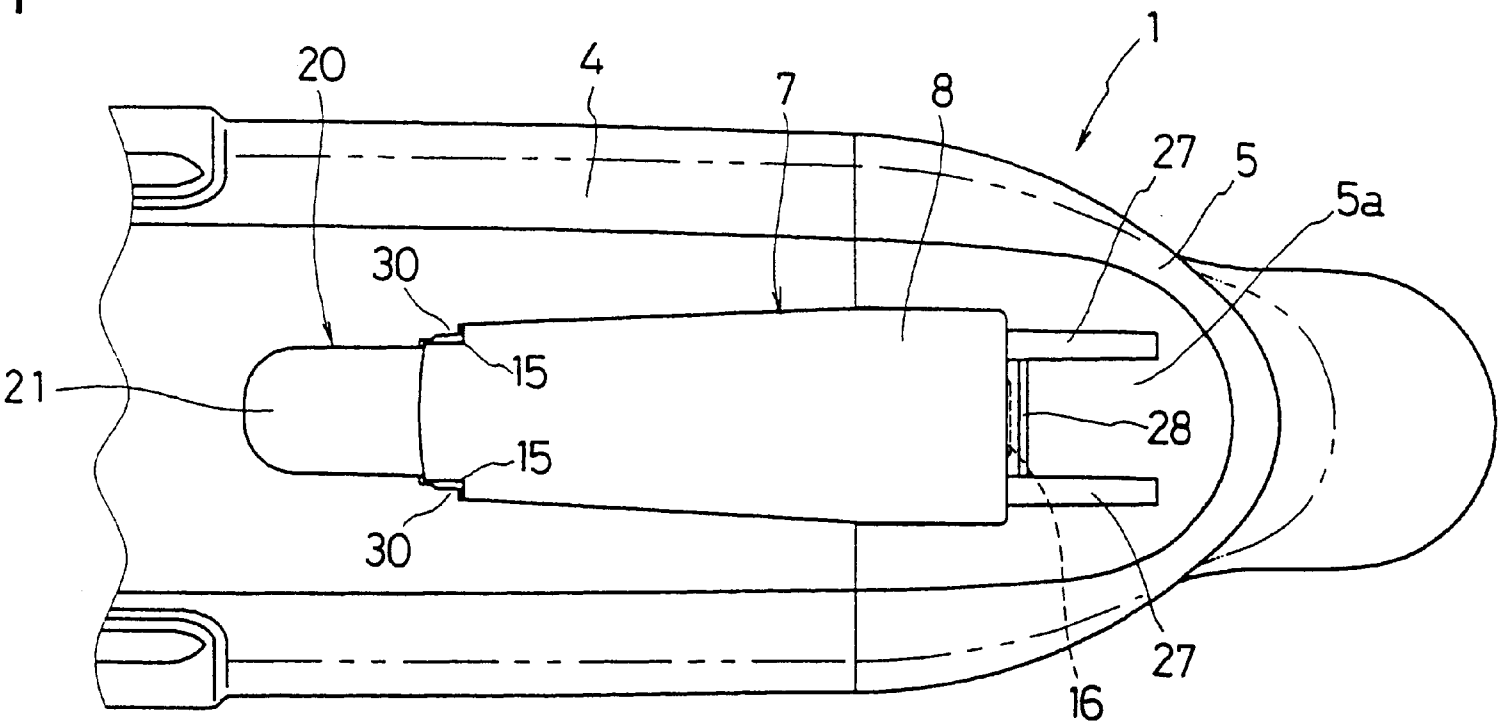
FIG. 4 is a partial plan view of the screwdriver shown in FIG. 1 showing the hook retracted in the accommodating, recess.
Figure 5:
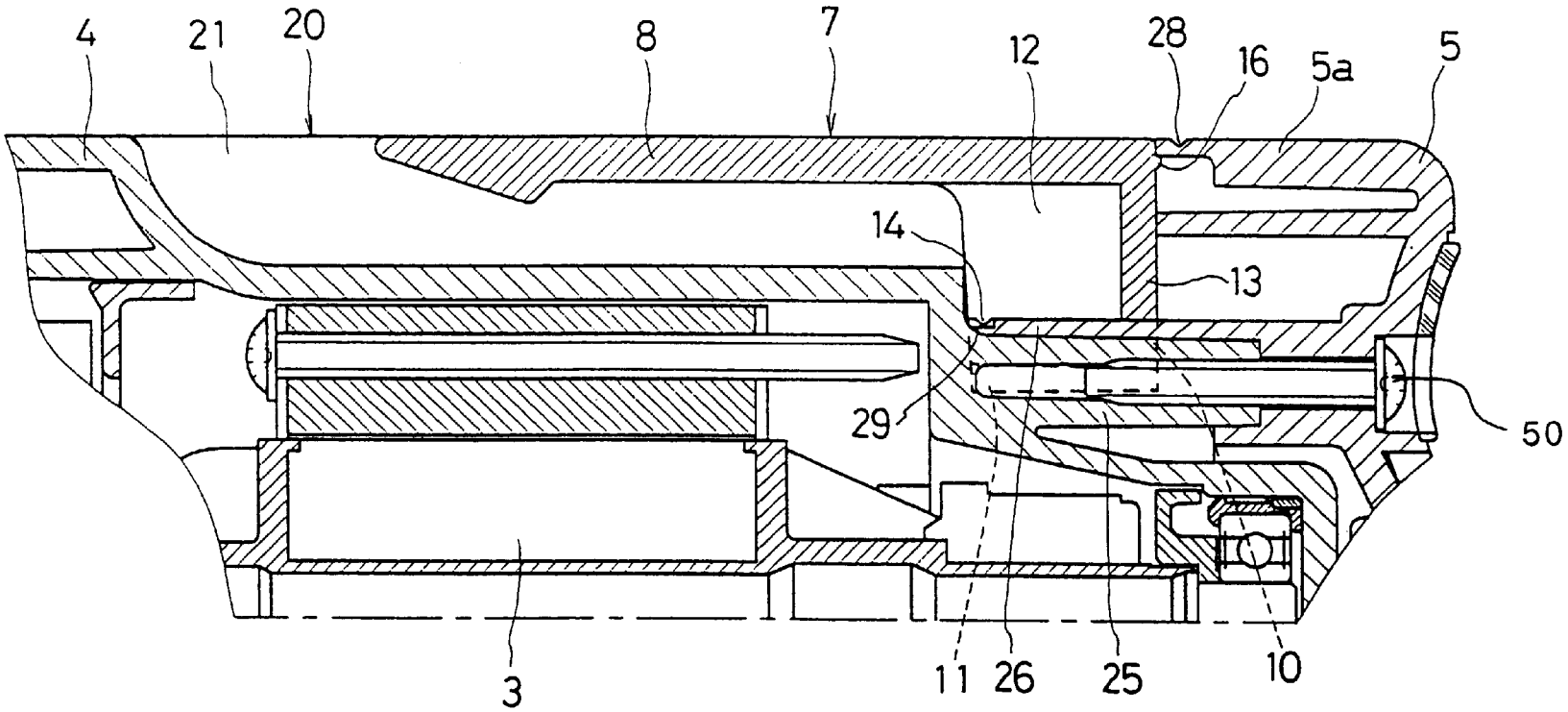
FIG. 5 is a longitudinal cross section of the screwdriver shown in FIG. 1, showing the hook retracted in the accommodating recess.
Figure 6:
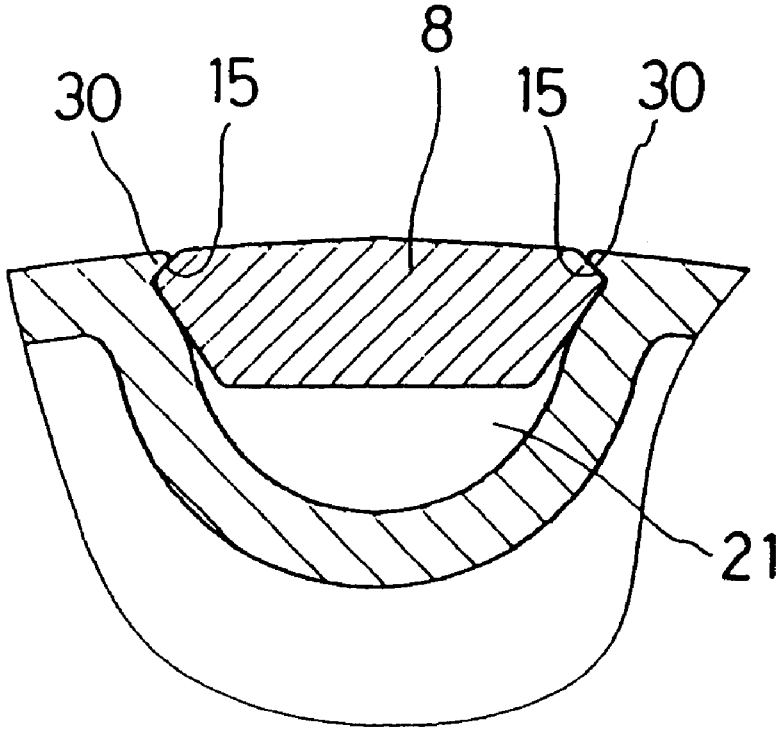
FIG. 6 is a traversal cross section of the screwdriver shown in FIG. 1, showing the front portion of the hook secured in the accommodating recess by securing means.

An accommodating recess 20 is grooved along the longitudinal axis of the tool bit 2 in the upper portions of the motor housing 4 and the handle cover 5 (the term "upper", as used herein, refers to the side of the motor housing 4 opposite to, i.e., away from, where the grip handle 6 is connected to the motor housing). A hook or a suspending device 7 is attached to the accommodating recess 20 as a device to suspend the screwdriver 1. As shown in FIG. 2, the hook 7 includes a generally tongue-shaped extending portion 8 and a base block 9 formed at the rear of the extending portion 8. The base block 9, i.e., a base portion, includes a pair of slide plates 10, i.e., a pair of first vertical plate members, which extends parallel to each other from the extending portion 8 and which are separated by a distance approximately corresponding to the width of the extending portion 8. Two retainer flanges 11 extend outward from the free ends of the slide plates 10. The base block 9 additionally includes a support plate 12, i.e., a second vertical plate member, provided parallel to and between the slide plates 10 and a traversal plate 13 that connects the slide plates 10 and the support plate 12. As illustrated, the support plate 12 has a slightly smaller vertical dimension than the slide plates 10. As shown in FIGS. 2, 5, and 6, reference numeral 14 denotes a protrusion formed on the lower front end of the lower surface of the support plate 12, whereas reference numeral 15 (see FIG. 2) denotes a pair of cut-outs 15 formed at the front comers of the extending portion 8. Referring to FIGS. 4 and 5, reference numeral 16 refers to a stopper protrusion formed widthwise at the rear surface of the base block 9.

Referring again to FIG. 2, the accommodating recess 20 includes a first groove 21 formed in the motor housing 4 and dimensioned slightly longer toward to the top of the tool 1 than the extending portion 8. The accommodating recess 20 further includes a second groove 22 formed deeper than the first groove 21 in the handle cover 5 so as to completely accommodate the base block 9. The opening formed by the first and second grooves 21 and 22 has a shape such that the extending portion 8 can be exactly fitted therein. The opening is trimmed with receiving tapering edges 23 (the second groove 22) and receiving tapers 24 (the first groove 21). These receiving tapering edges 23 abut tapering edges 17 formed around the extending portion 8. Additionally the receiving tapering edges 23 slightly protrude inward from the respective inner walls of the second groove 22. A partial cylindrical portion 26 is formed at the bottom of the second groove support plate 12 has a slightly smaller vertical dimension than the slide plates 10. As shown in FIGS. 2, 5, and 6, reference numeral 14 denotes a protrusion formed on the lower front end of the lower surface of the support plate 12, whereas reference numeral 15 (see FIG. 2) denotes a pair of cut-outs 15 formed at the front comers of the extending portion 8. Referring to FIGS. 4 and 5, reference numeral 16 refers to a stopper protrusion formed widthwise at the rear surface of the base block 22 in order to receive a boss 25 protruding from the rear of the motor housing 4. A screw 50 (see FIG. 5) is tightened into the boss 25 to secure the handle cover 5 to the motor housing 4. A pair of L-shaped support slots 27 are formed in the second groove 22 at its rear end so that the retainer flanges 11 of the slide plates 10 can be fit into the respective grooves 27 along the longitudinal axis of the tool bit 2. Each support groove 27 has a length corresponding to the length of the slide plate 10. Additionally, a traversal engaging groove 28 is provided between the support slots 27 in the top wall 5*a* of the handle cover 5 such that the protrusion 14 on the support plate 12 of the hook 7 can engage the groove 28. Moreover, a chamfer 24 is provided in the top front end of the cylindrical portion 26 so as to avoid interference with the protrusion 14 when the base block 9 is accommodated in the second groove 22. Referring to FIG. 5 as well as FIG. 2, reference numeral 30 denotes a pair of retainer lugs at the front ends of the receiving tapers 24 provided for engaging the cut-outs 15 of the extending portion 8 of the hook 7.

Figure 3A:
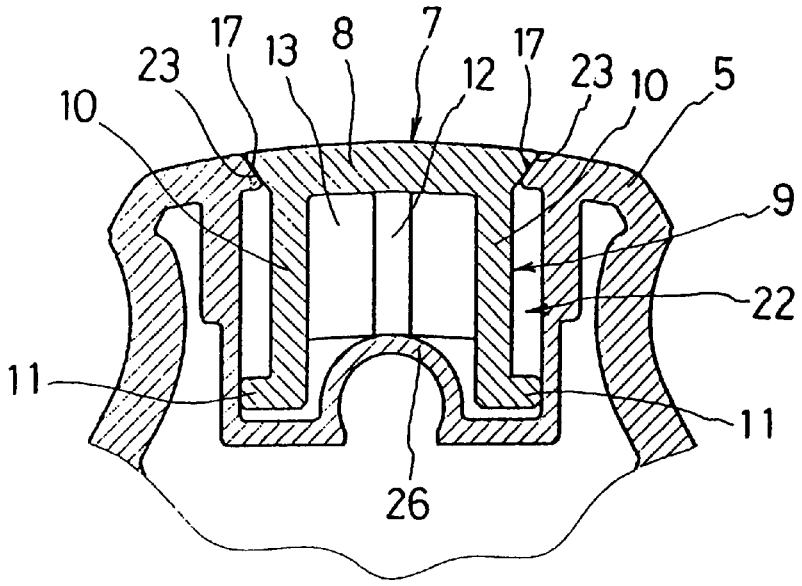
FIG. 3A is a traversal cross section of the screwdriver shown in FIG. 1 showing the hook retracted in the accommodating recess.

To assemble the hook 7 to the screwdriver 1, the handle cover 5 is assembled to the motor housing 4 with the base block 9 inserted in the second groove 22. When the screw 50 is tightened into the boss 25 to secure the handle cover 5 to the motor housing 4, the hook 7 is trapped between the handle cover and the motor housing, with the retainer flanges 11 of the slide plates 10 interfering with the receiving tapering edges 23 of the second groove 22. As shown in FIG. 3A, when the hook 7 is not used, the base block 9 is inserted into the second groove 22. In this position, the base block 9 is accommodated in the second groove 22 with the tapering edges 17 of the hook 7 abutting the receiving tapering edges 23 of the second groove 22. As shown in FIGS. 4 and 5, the hook 7 fits in the accommodating recess 20 flush with the top surface of the motor housing 4 and the handle cover 5, exposing only the extending portion 8. As additionally shown in FIG. 6, when the hook 7 is pushed down in place, the cut-outs 15 in the extending portion 8 fit in and elastically engage the respective retainer lugs 30, holding the hook 7 in the retracted position in a stable manner. As shown FIG. 5, the extending portion 8 fits in place while the stopper ridge 16 simultaneously engages the rear surface of the top wall 5*a* of the handle cover 5, i.e., an outer surface area of the housing, thus stably retaining the hook 7 on the base block 9 as well.

Figure 3B:
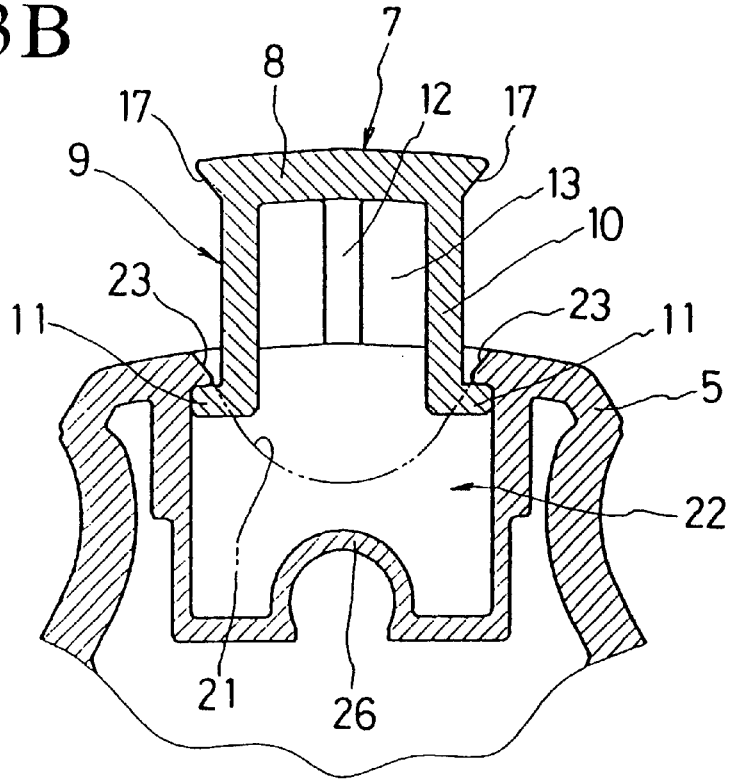
FIG. 3B is a traversal cross section of the screwdriver shown in FIG. 1, showing the hook drawn out of the accommodating recess.
Figure 7:
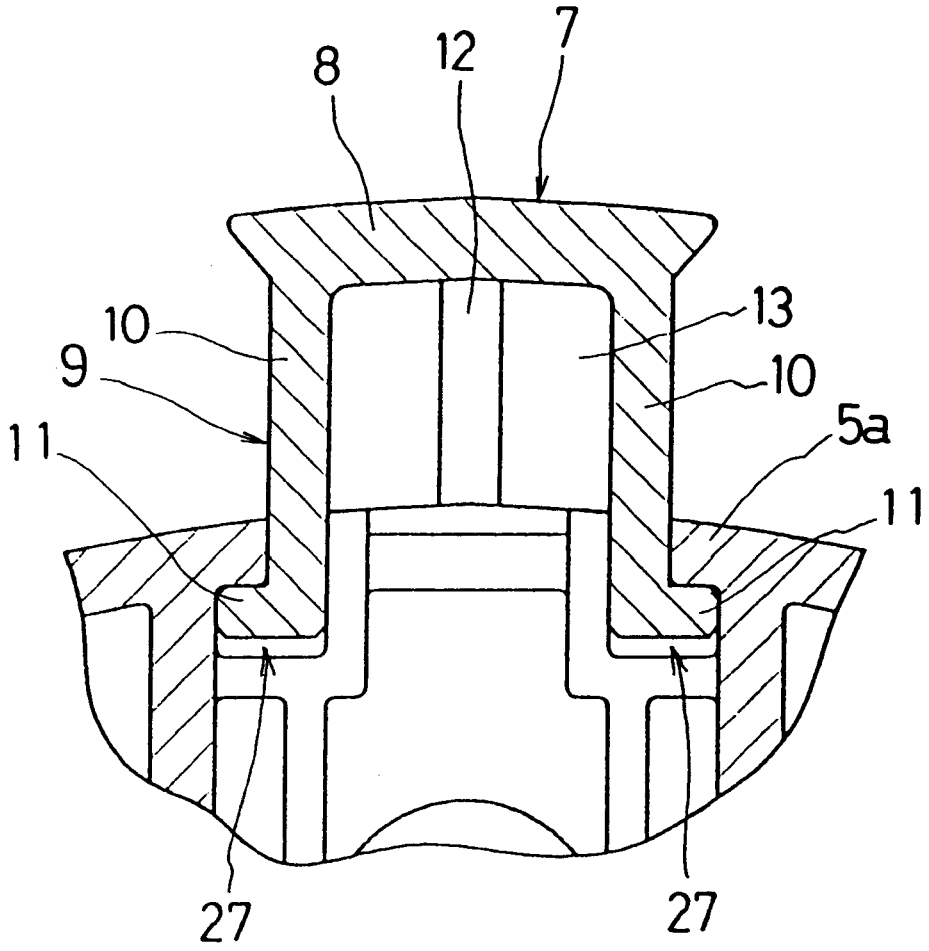
FIG. 7 is a traversal cross section of the screwdriver shown in FIG. 1, showing the hook drawn out of the accommodating recess and secured in the retracted position.
Figure 8:
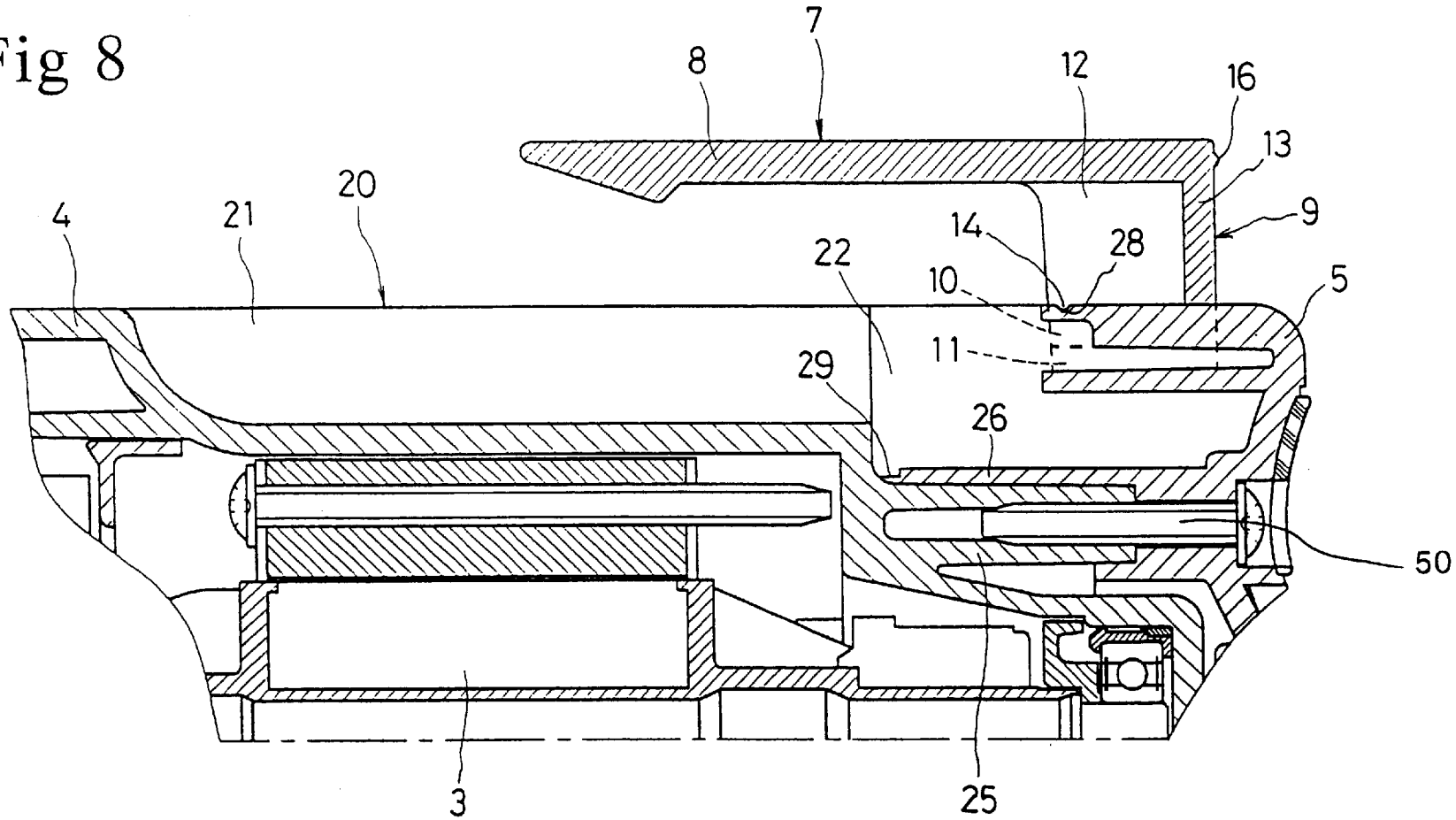
FIG. 8 is a longitudinal cross section of the screwdriver shown in FIG. 1, showing the hook drawn out of the accommodating recess and secured in the retracted A position.
Figure 9:
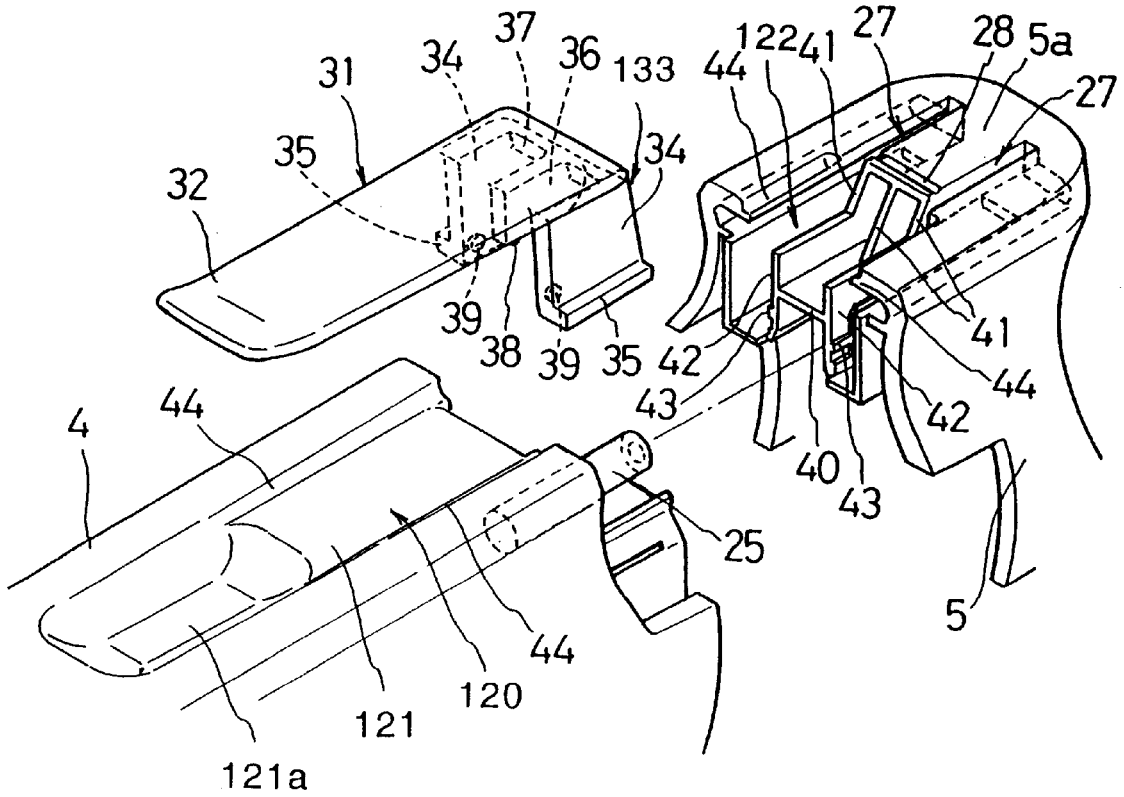
FIG. 9 is an exploded view of a hook and an accommodating recess of an electric power screwdriver of a second embodiment.

With reference to FIGS. 3A and 3B to draw out the hook 7 from the retracted position, the operator can insert a finger into the first groove 21 through the gap between the top of the extending portion 8 and the front end of the groove 21 and pull up the top of the extending portion 8. This disengages the stopper ridge 16 from the handle cover 5 and also disengages the cut-outs 15 of the extending portion 8 from the retainer lugs 30, such that the hook 7 projects out of the accommodating recess 20. In this position, the retainer flanges 11 of the slide plates 10 abut the receiving tapering edges 23 of the second groove, preventing the hook 7 from slipping upwardly out of the second groove 22. Due to the difference in depth between the first and second grooves 21 and 22, the front ends of the retainer flanges 11 of the slide plates 10 interfere with the motor housing 4 when moved forward, also preventing the hook 7 from slipping out of the first groove 21. When the base block 9 is slid rearward from the position shown in FIG. 3B, the free ends of the slide plates 10 enter the support slots 27. It should be noted that the support plate 12 does not clear and travel over the top wall 5*a* of the handle cover 5 unless the slide plate 12 is pulled to its upper limit? where the retainer flanges 11 come into contact the underside of the top wall 5*a*. As shown in FIGS. 7 and 8, when the hook 7 is manually slid rearward until the protrusion 14 on the support plate 12 engages the traversal groove 28, the under surfaces of the support plate 12 and the traversal plate 13 abut the upper surface of the top wall 5*a*, whereas the upper surfaces of the retainer flanges 11 abut the under surface of the top wall 5*a*. This arrangement stably supports the base block 9 and thus the hook 7 in its drawn-out or projecting position without rattling, allowing safe and stable suspension of the screwdriver 1 on an appropriate structure on a wall.

To retract the hook 7, the foregoing procedure is reversed. That is, the hook 7 is slid forward from the position shown in FIG. 8 so as to disengage the slide plates 10 from the support slots 27 and reintroduce the base block 9 into the second groove 22. By fitting the base block 9 into the second groove 22 and the extending portion 8 into the first groove 21, the hook 7 can be Securely fitted in the accommodating recess 20.

As described above, according to the foregoing first embodiment, the hook 7 can be drawn out for use and retracted when not used without the use of any pin, screw, or other element. Rather, the arrangement and the configurations of the motor housing 4, the handle cover 5, and the hook 7 realize a structure that allows the hook 7 to be selectively retracted and drawn out of the accommodating recess 20 contributing to a reduction in cost and the number of assembly steps. Furthermore, as the hook 7 is securely fixed when it is either in the retracted or drawn-out position, not only does the screwdriver 1 not swing on the drawn-out hook 7 when it is hung on the wall, but the hook is also prevented from inadvertent projection out of the accommodating recess 20 (due to the engagement between the cut-outs 15 and the retainer lugs 30 and also due to the engagement between the stopper ridge 16 and the top wall 5*a* of the handle cover 5). Furthermore, the hook 7 can be easily retracted simply by sliding the base block 9 out of the support slots 27 and fitting the base block 9 into the accommodating recess 20. Conversely, the hook 7 can be equally easily drawn out simply by pulling up the base block 9 out of the recess 20 and sliding the base block 9 into the support slots 27. This greatly improves on conventional structures in terms of operability.

Embodiment 2

An alternate structure for attaching a suspending hook to an electric power tool is described hereinafter with reference to the attached drawings, in which identical or similar reference numerals or characters denote identical or similar parts or elements throughout the several views. Therefore, description of such elements is omitted.

Figure 10:
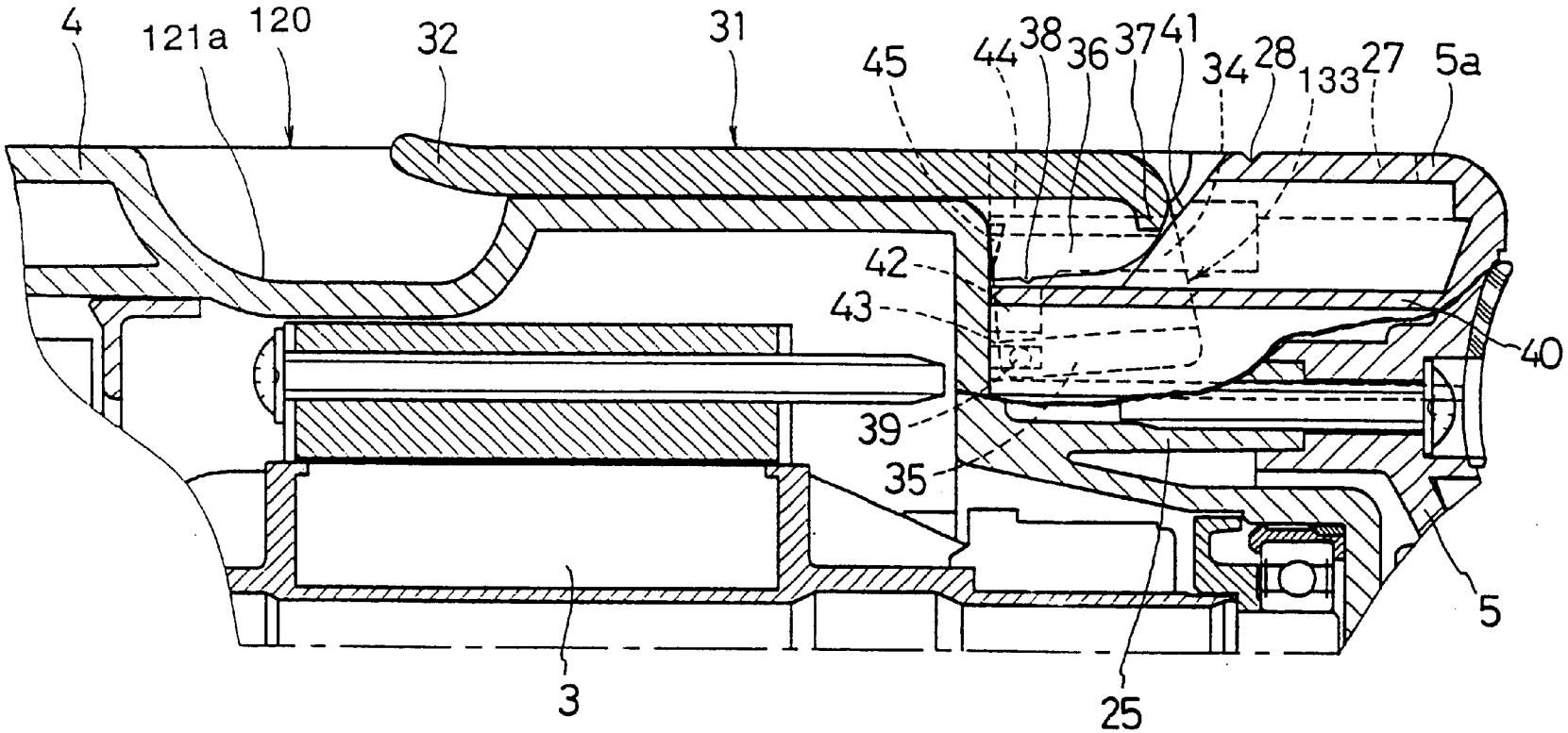
FIG. 10 is a longitudinal cross section of the screwdriver shown in FIG. 9, showing the hook retracted in the accommodating recess.

The embodiment of the invention seen in FIGS. 9 to 12 includes an alternate hook 31 which in turn includes a base block 133 In the base block 133, a pair of slide plates 34 and a support plate 36 are connected by a protruding ridge 37. As shown in FIG. 10, the rear surfaces of the support plate 36 and the protruding ridge 37 are rounded. As best shown in FIGS. 12A and 12B, the slide plates 34 are formed with stopper protrusions 39 at the lower front ends of the opposing inner surfaces thereof. The front end of the extending portion 32 is curved slightly upward.

Figure 11:
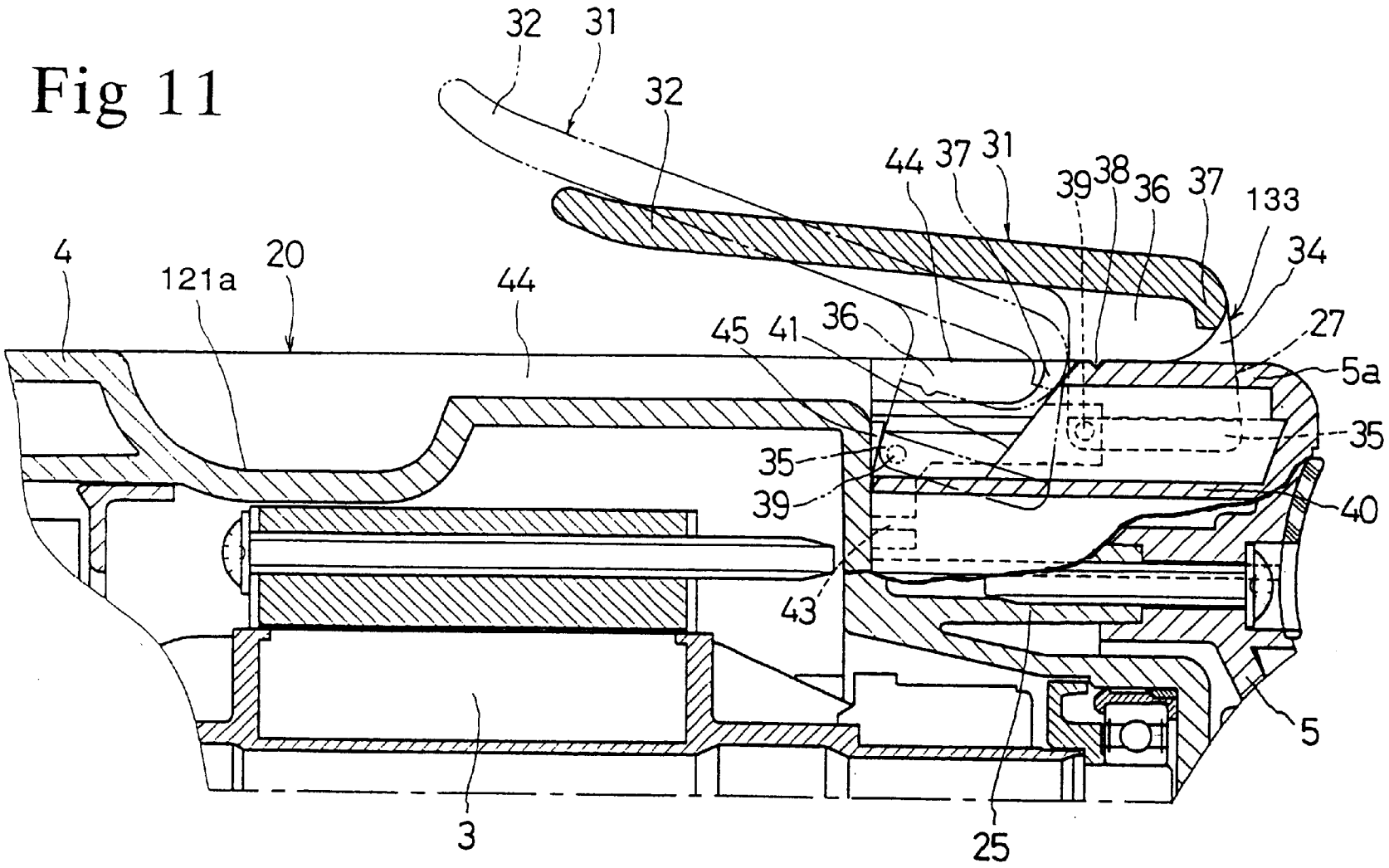
FIG. 11 is a longitudinal cross section of the screwdriver shown in FIG. 9, showing in solid lines the hook drawn out of the accommodating recess and secured in the retracted position and also showing the top of the hook pulled up in phantom lines.

Referring again to FIG. 9, the motor housing 4 is provided with an accommodating recess 120 whose first groove 121 has a flat bottom surface with approximately the same depth as the thickness of the extending portion 32. The front portion 121*a* of the first groove 121 is formed deeper than the remaining bottom surface. The accommodating recess 120 additionally includes a second groove 122 which has an elevated center portion 40 with an approximately H-shaped cross section under which the boss 25 is inserted. The elevated center portion 40 is provided with three inclined ribs 41, two on the side edges and one in the middle of the center portion, which rise as they extend rearward until connected to the top wall 5*a* of the handle cover 5. These inclined ribs 41 guide the support plate 36 and the protruding ridge 37 when the hook 31 is drawn out or retracted. A pair of recesses 42 is provided in the outside surfaces of the center portion 40 so as to allow the stopper protrusions 39 to move thereon as the hook 31 is manually moved. Moreover, a pair of stoppers 43 is provided on the outside surfaces of the center portion 40 below the recess 42. The stopper protrusions 39 can ride over the stoppers 43 due to the elastic deformation of the slide plate 34. A pair of receiving grooves 44 for seating both sides of the extending portion 32 is formed at both longitudinal sides of the accommodating recess 120, continuously extending from the first groove 121 into the second groove 122. The receiving grooves 44 in the second groove 122 have overhanging edges extending inwardly so as to interfere with the retainer flanges 35 as the flanges are pulled upward. With reference to FIGS. 10 to 12, reference numeral 45 denotes a pair of guide protrusions that provide a pair of front inclined surfaces on the rear surface of the motor housing 4 which defines the front wall of the second groove 122. The guide protrusions 45 are longitudinally aligned with the free ends of the retainer flanges 35 and define forwardly tilted surfaces.

Figure 12A:
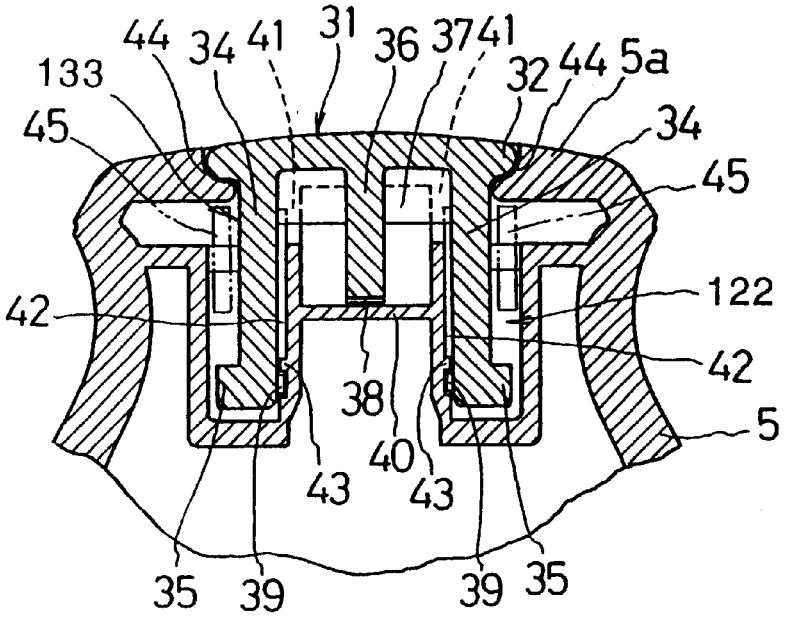
FIG. 12A is a traversal cross section of the screwdriver shown in FIG. 9, showing the hook retracted in the accommodating recess.
Figure 12B:
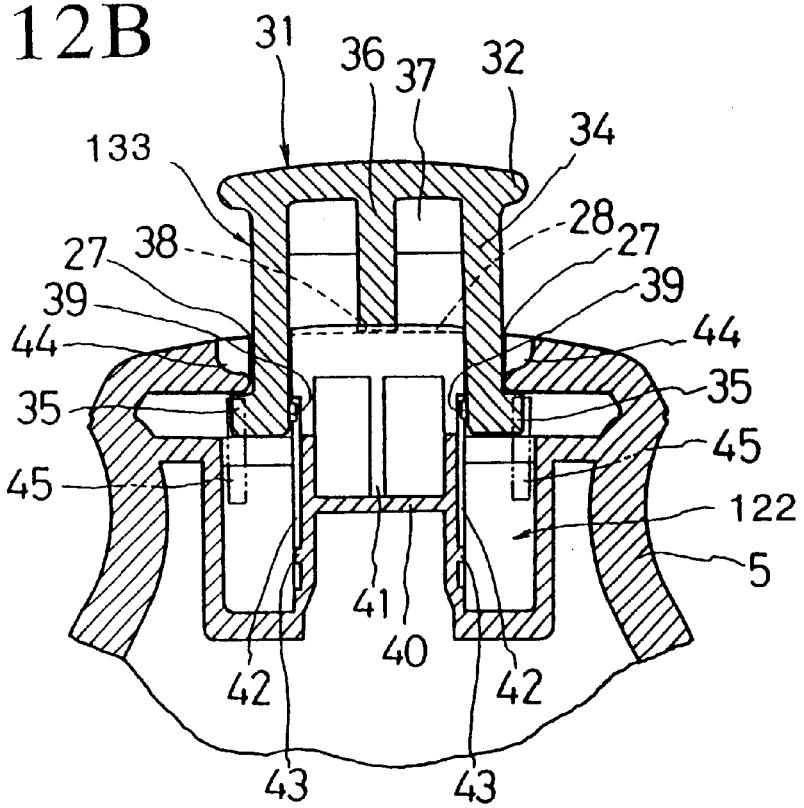
FIG. 12B is a traversal cross section of the screwdriver shown in FIG. 9, showing the hook drawn out of the accommodating recess and secured in the retracted position.

When the hook 31 is assembled to the screwdriver 1 between the motor housing 4 and the handle cover 5 in a substantially identical manner as in the first embodiment, the retainer flanges 35 of the slide plates 34 interfere with the receiving, grooves 44 of the second groove 122, thus preventing the hook 31 from slipping out of the accommodating recess 120. As shown in FIGS. 10 and 12A, to retract the hook 31, the base block 133 is pushed into the second groove 122, so that the stopper protrusions 39 of the slide plates 34 ride over the stoppers 43 due to the elasticity of the slide plate 34 and fit into the lower front end of the recesses 42 below the stoppers 43. Simultaneously, the side edges of the extending portion 32 falls in place so as to be supported by the receiving grooves 44, thus laying the hook 31 flush in the accommodating recess 120, with only the top surface of the extending portion 32 exposed. In this position, the hook 31 is securely held in place as the protrusions 39 are prevented from moving upward by the stoppers 43.

To draw out the hook 31 for use, the operator inserts a finger or an appropriate tool into the first groove 121 at the front portion 121 a and pulls up the extending portion 32 at its tip. This causes the stopper protrusions 39 to ride over the stopper 43, thus releasing the stopper protrusions 39. As shown in FIG. 11 in phantom lines, when the hook 31 is slid rearward, the rear ends of the support plate 36, i.e., a second track member, and the protruding ridge 37 are guided upwards on the inclined ribs 41, i.e., a first track member. While the hook 31 is pulled up as described above, the front ends of the retainer flanges 35 slide on the forwardly tilted surfaces of the guide protrusions 45 so that the support plate 36 and the protruding ridge 37 smoothly abut and slide on the inclined ribs 41.

As the hook 31 continues to be slid rearward, the support plate 36 rides over the top wall 5*a* of the handle cover 5 while the lower free ends of the slide plates 34 enter the support slots 27, i.e., a third track member. As shown in FIG. 11 in solid lines and in FIG. 12B' when the hook 31 is further moved backward, a protrusion 38 on the lower surface of the support plate 36 fits in the traversal groove 28 while the upper surfaces of the retainer flanges 35, a forth track member, abut the rear surfaces of the top wall 5*a*, securing the hook 31 without rattling while in this drawn-out or projecting position.

To retract the hook 31 the foregoing steps are followed in reverse. Specifically, when the hook 31 is slid forward from the position shown in solid lines in FIG. 11, the slide plates 34 exit the support slots 27 and reenter the second groove 122.

The hook 31 is then set in place as described above by pushing the base block 133 into the second groove 122.

According to the foregoing second embodiment as in the first embodiment, the hook 31 can be drawn out for use and retracted when not used without using any pin, screw, or other elements. Rather, the arrangement and the configurations of the motor housing 4, the handle cover 5, and the hook 31 realize a structure that allows the hook 31 to be selectively retracted and drawn out of the accommodating recess 120, contributing to a reduction in cost and the number of assembly steps. Furthermore. as the hook 31 is securely fixed when it is either in the retracted or drawn-out position, not only does the screwdriver 1 not swing on the drawn-out hook 31 when it is hung on the wall, but the hook is also prevented from inadvertent extension out of the accommodating recess 120. In particular, due to the inclined ribs 41 provided between the second groove 122 and the support slots 27 for guiding the base block 133, the hook 31 is smoothly guided to and secured in the drawn-out position. Sliding and securing the hook 31 in this position is even more simplified, thus enhancing the overall operability of the screwdriver 1. By using as securing means the stopper protrusions 39 of the slide plates 34 and the stoppers 43 of the center portion 40, the hook 31 can be securely held in the retracted position with minimum structures. The securing means of the second embodiment is more simplified than that of the first embodiment which includes the stopper ridge 16 at the rear surface of the base block 9, the cut-outs 15 at the front corners of the extending portion 8, and the retainer lugs 30 of the first groove 21. It should be noted that the inclined ribs 41 of the second embodiment may be replaced with an inclined surface or an inclined and curved surface. Those with ordinary skill in the art will appreciate that the rear surfaces of the support plate 36 and the protruding ridge 37 need not be rounded as in the second embodiment, these surfaces may be flat inclined surfaces slidable on the guide ribs 41. The structure of the second embodiment greatly improves on conventional structures in terms of operability.

In the foregoing two embodiments, the support slots 27 are extended in the same direction as the longitudinal axis of the accommodating recess 20, so that the hook 7 are moved longitudinally in order to draw out and retract the hook. It should be noted that such support slots or any other appropriate support means may be oriented orthogonal to the longitudinal axis of the accommodating recess or any other appropriate accommodating means, with the retainer means (such as flanges) also extended orthogonal to the longitudinal axis of the accommodating recess. In such a configuration, the hook is also moved orthogonal to the longitudinal axis of the accommodating recess when it is drawn out and retracted.

The shape of the suspending device is not limited to those according to the embodiments to fall within the scope of the invention. As long as it includes a base portion, such as the base block 9 or 133, which is retained in the housing of the electric tool, the suspending device may be formed in the shape of a pipe, rod, or perforated plate.

Furthermore, the hook need not be provided at the upper surface of the screwdriver as in the foregoing embodiments; it may be provided at any convenient position, such as at a side surface of the housing or the grip handle. Those with ordinary skill in the art will appreciate that the present invention may be applied to any electric power tool, such as a power drill, in addition to screwdrivers as described above.

EFFECTS OF THE INVENTION

According to the invention, a suspending device of an electric power tool can be drawn out for use and retracted when not used without using any pin, screw, or other elements. Rather, the arrangement and the configurations of the housing and the suspending device realize a structure that allows the suspending device to be selectively retracted and drawn out of an accommodating portion, contributing to a reduction in cost and the number of assembly steps. Furthermore, as the suspending device is securely fixed when it is either in the retracted or drawn-out position, not only does the electric power tool not swing on the drawn-out suspending device when it is hung on the wall, but also is the device prevented from inadvertent extension out of the accommodating portion.

Furthermore, the suspending device can be easily retracted simply by slidingl a base portion of the device out of a support means of the housing and fitting the base portion into the accommodating portion. Conversely, the suspending device can be equally easily drawn out simply by pulling up the base portion out of the accommodating portion and sliding the base portion into the support means. This greatly improves the operability of electric power tools.

In one aspect of the invention, the guide means provided between the accommodating portion and the Support means facilitates the movement of the base portion to the support means, thus further enhancing the operability of the tool.

In another aspect, the securing means provided between the suspending device and the accommodating portion prevents accidental release of the suspending device from the retracted position, thus improving the reliability of the structure.

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments arc only an illustration and not restrictive in any sense. The scope or spirit of the present invention is limited only by the terms of the appended claims.

What is claimed is:

1. An electric power tool having a housing and a longitudinal axis and having the improvement comprising a hook member attached to the housing and movable relative to the housing between a retracted position and a deployed position, a recess formed in the housing and adapted for seatingly accommodating said hook member when in said retracted position, said recess having a first track member, and a second track member on said hook member slidable engaged with said first track member to slidably move said hook member along a first path relative to the housing into and alternatively out of said retracted position, said first path having at least a portion extending substantially perpendicular to said longitudinal axis.

2. The electrical power tool of claim 1, wherein said hook member includes a generally tongue-shaped extending portion and a base portion and said recess includes a first cavity for seatingly accommodating said extending portion and a second cavity for seatingly accomodating said base portion when said hook member is in said retracted position.

3. The electric power tool of claim 2, further comprising a third track member said housing transverse to said first track member and a fourth track member on said hook member for slidably engaging said third track member for slidably moving said hook member along a second path transverse to said first path such that said hook member moves successively along said first path and said second path in transition said retracted position to said deployed position.

4. The electric power tool of claim 2, wherein said extending portion includes tapered edges and said second cavity includes receiving tapered edges, a portion of said tapered edges of the extending portion abutting said receiving tapered edges of said second cavity when said hook member is in the retracted position.

5. The electric power tool of claim 2, wherein said first cavity includes tapered edges along a portion thereof of engage a portion of said tapered edges of the extending portion.

6. The electric power tool of claim 2, wherein said base portion forms a substantially normal angle with said extending portion.

7. The electric power tool of claim 2, wherein said base portion includes a pair of slide plates extending from said extending portion parallel to each other and seperated from each other by a distance approximately equal to a width of the extending portion.

8. The electric power tool of claim 7, wherein said base portion further includes a pair of retaining flanges, each of said pair of flanges extending outwardly from one of said slide plates.

9. The electric power tool of claim 7, further comprising a support plate disposed between said pair of slide plates and parallel therewith.

10. The electric power tool of claim 9, further comprising a transversal plate extending between said slide plates and connecting said slide plates together and to said support plate.

11. The electric power tool of claim 7, wherein two surfaces of said slide plates form said second track member and a vertical wall of said second cavity forms said first track member.

12. The electric power tool of claim 3, wherein said base portion includes a pair of retaining flanges and said third track member is raised relative to said recess and has two portion seperated by a surface of the housing, and two horizontal surfaces of said retaining flanges form the fourth track member, said third track member slidably engaging said fourth track member for slidable movement of said hook member along the second path.

13. The electric power tool of claim 3, wherein said second path is along the longitudinal axis of the power tool.

14. The electric power tool of claim 3, wherein said third track member has a length substantially equal to a length o said slide plates.

15. The electric power tool of claim 12, wherein said support plate includes a protrusion on a lower surface thereof and said surface of the housing separating said two portions of said track member includes a recess for engaging said protrusion to lock said hook member in the deployed position.

16. The electric power tool of claim 2, wherein said extending portion of said hook member includes a pair of cut-outs disposed in corners of an end thereof opposite said base portion, and said first cavity includes a pair of retainer lugs for elastically engaging said pair of cut-outs, thereby stably retaining said hook member in said recess when said hook member is in the retracted position.

17. A suspendable electric power tool comprising a suspending device having a base portion and an extending portion connected to the base portion, a housing having an accommodating portion for accommodating the suspending device, retaining means provided for retaining the base portion of the suspending device to the housing, the retaining means being movable within the accommodating portion of the housing and preventing the base portion from slipping out of the accommodating portion, wherein the base portion is connected to the accommodating portion so as to permit the base portion to project out of, and retract into, the accommodating portion, support means provided adjacent the accommodating portion for supporting the retaining means when the base portion is projected out of the accommodating portion, wherein the suspending device is accommodated in the accommodating portion when the base portion is retracted into the accommodating portion and the suspending device is drawn out of the accommodating portion when the base portion projects out of the accommodating portion.

18. The suspendable electrical power tool of claim 17 further comprising guide means provided on the accommodating portion for guiding the base portion of the suspending device to the support means.

19. The suspendable electrical power tool of claim 17 wherein the accommodating portion is a recess which is provided in the housing and includes a first groove for accommodating the extending portion of the suspending device and a second groove for accommodating the base portion of the suspending device.

20. The suspendable electrical power tool of claim 17 wherein the suspending device has a generally L-shaped cross section taken along a longitudinal axis thereof, with the vertical stroke of the L corresponds to the extending portion and the horizontal stroke of the L corresponds to the base portion, and further wherein the suspending device is accommodated in the electric power tool flush with the housing when the base portion of the suspending device is in the accommodating portion.

21. The suspendable electrical power tool of claim 18 wherein an electric power tool further includes a tool bit attached to a front end thereof, the tool bit having an axis parallel to a longitudinal axis of the suspending device, and further wherein the support means is located on a rear end of the electric power tool such that the tool bit, the extending portion, the base portion, and the support means are disposed in that order along the longitudinal axis when the suspending device is accommodated in the accommodating portion, and the base portion travels over the guide means when the suspending device is drawn out of the accommodating portion.

22. The suspendable electrical power tool of claim 18 wherein the guide means comprises at least one rear inclined surface provided on a wall of a second groove adjacent the support means, the at least one rear inclined surface connecting the second groove and the support means, wherein the base portion abuts and slides on the at least one rear inclined surface when moved to the support means.

23. The suspendable electrical power tool of claim 22 wherein the guide means further comprises at least one front inclined surface provided on a wall of the second groove adjacent the first groove for facilitating the movement of the base portion to the support means.

24. The suspendable electrical power tool of claim 17 wherein the base portion has at least one first vertical plate member each having a free end to which the retaining means is attached and at least one second vertical plate member, further wherein the support means comprises;

an outer surface area of the housing, at least one slot provided in the outer surface area of the housing for receiving the at least one first plate member when the base portion is projected out of the accommodating portion, and an undersurface of the at least one vertical second plate member which abuts the outer surface area of the housing when the base portion is projected out of the accommodating portion, and further wherein the first plate member, the second plate member, and the at least one slot are oriented parallel to the longitudinal axis such that the first plate member enters the slot when the base portion is moved to the support means.

25. The suspendable electrical power tool of claim 24 wherein the retaining means comprises a flange extending from the free end of the at least one first plate member, the flange having a width greater than that of the width of the slot at the outer surface area of the housing, whereby the retaining member, attached to the at least one first plate member inside the housing, prevents the base portion from slipping out of the housing.

26. The suspendable electrical power tool of claim 17 further comprising engaging means provided between the suspending device and the accommodating portion for securing the suspending device to the accommodating portion when the suspending device is in the accommodating portion.

27. The suspendable electrical power tool of claim 26 wherein the engaging means includes at least one recess provided in the accommodating portion and further includes at least one protrusion provided on the suspending device for engaging the recess when the suspending device is in the accommodating portion.

28. The suspendable electrical power tool of claim 26 wherein the engaging means includes at least one groove provided in the accommodating portion and further includes at least one ridge provided on the suspending device, the at least one ridge engaging the at least one groove when the suspending device is in the accommodating portion.

29. The suspendable electrical power tool of claim 28 further comprising second engaging means which includes a second groove provided in the support means and a second ridge provided on the suspending device for engaging the second groove when the suspending device is drawn out of the accommodating portion.

30. The suspendable electrical power tool of claim 19, wherein the first groove is configured such that the first groove provides a sufficient gap between a top end thereof and a top end of the extending portion for insertion of a human finger tip into the gap when the suspending device is in the accommodating portion so as to allow the suspending device to be drawn out of the accommodating portion manually.

31. The suspendable electrical power tool of claim 17 wherein a handle cover is attached a motor housing, and further wherein the suspending device and the accommodating portion are located in a portion of the housing opposite to where a grip handle is attached to the motor housing.

* * * * *

UNITED STATES PATENT AND TRADEMARK OFFICE

CERTIFICATE OF CORRECTION

PATENT NO. : 6,321,622 B1
DATED : November 27, 2001
INVENTOR(S) : Kazunori Tsuge, Yukihiko Yamada and Tomohiro Ukai It is certified that error appears in the above-identified patent and that said Letters Patent is hereby corrected as shown below:

Column 11,
Line 62, replace "transition said" with -- transition from said --;

Column 12,
Line 4, replace "of" with -- to --;
Line 31, replace "portion" with -- portions --;
Line 39, replace "length o" with -- length of --; and
Line 44, replace "said track" with -- said third track --.

Signed and Sealed this

Seventh Day of May 2002

*Attest:*

*Attesting Officer*

JAMES E. ROGAN
*Director of the United States Patent and Trademark Office*